US007703712B2

(12) United States Patent
Chiu et al.

(10) Patent No.: US 7,703,712 B2
(45) Date of Patent: Apr. 27, 2010

(54) TABLET GRINDING DEVICE

(76) Inventors: Chun-Chun Chiu, Room 2105, Sun Life Tower, The Gateway, Harbour City, 15 Canton Road, Tsimshatsui, Kowloon, Hong Kong (CN); Alfred Wah-Hang Yuen, Room 2105, Sun Life Tower, The Gateway, Harbour City, 15 Canton Road, Tsimshatsui, Kowloon, Hong Kong (CN)

( * ) Notice: Subject to any disclaimer, the term of this patent is extended or adjusted under 35 U.S.C. 154(b) by 0 days.

(21) Appl. No.: 11/820,372

(22) Filed: Jun. 19, 2007

(65) Prior Publication Data

US 2008/0210791 A1 Sep. 4, 2008

(30) Foreign Application Priority Data

Mar. 1, 2007 (HK) ..... 07 1 02314

(51) Int. Cl.
*B02C 19/00* (2006.01)

(52) U.S. Cl. ..... 241/100; 241/169.1; 241/DIG. 27

(58) Field of Classification Search ..... 241/DIG. 27, 241/169.1, 100
See application file for complete search history.

(56) References Cited

U.S. PATENT DOCUMENTS

| | | | | |
|---|---|---|---|---|
| 5,148,995 | A * | 9/1992 | Hurst | 241/30 |
| 7,032,851 | B2 * | 4/2006 | Demske et al. | 241/221 |
| 2007/0181724 | A1 * | 8/2007 | Shears | 241/285.2 |

FOREIGN PATENT DOCUMENTS

| | | |
|---|---|---|
| DE | 12 42 331 B | 6/1967 |
| DE | 12 42 332 B | 6/1967 |
| EP | 0 526 180 A | 2/1993 |

* cited by examiner

*Primary Examiner*—Mark Rosenbaum
(74) *Attorney, Agent, or Firm*—Alix, Yale & Ristas, LLP

(57) ABSTRACT

A device for grinding tablets includes a body, an electric motor housed within the body, a power source connected to the electric motor via a switch, a grinder driven to rotate by the electric motor, a tablet chute to the grinder, and a particle bin attached to or formed integrally with the body for receiving particles from the grinder.

8 Claims, 3 Drawing Sheets

TABLET GRINDING DEVICE

BACKGROUND OF THE INVENTION

The present invention relates to a device for grinding tablets/pills. More particularly, although not exclusively, the invention relates to a handheld device into which whole tablets can be inserted for grinding into particulate form.

Tablets come in different sizes depending upon the prescribed or desired dosage. Some tablets are provided with a score line to facilitate easy breakage into two parts. Where a dosage smaller than half a tablet is desired, further breakage becomes difficult—especially for elderly people or people with arthritic conditions for example. For this reason, it is often desired to grind tablets into powdered form for subsequent ease of portioning.

Some tablets are not rapidly absorbed into the body after being taken. Grinding of tablets into granular or powdered form increases the rate of absorption in the body.

OBJECTS OF THE INVENTION

It is an object of the present invention to provide a handheld device with which consumers can grind tablets into smaller particles.

DISCLOSURE OF THE INVENTION

There is disclosed herein a device for grinding tablets, comprising:

a body, an electric motor housed within the body, a power source connected to the electric motor via a switch, a grinder driven to rotate by the electric motor, a tablet chute to the grinder, and a particle bin attached to or formed integrally with the body for receiving particles from the grinder.

Preferably, the grinder is substantially cylindrical and rotates about a longitudinal axis thereof.

Preferably, the device further comprises a substantially cylindrical grinding cavity within which the grinder rotates.

Preferably, the tablet chute extends radially of the longitudinal axis of the grinder.

Preferably, the tablet chute extends tangentially of the grinding cavity.

Preferably, the grinder includes a pair of diametrically opposed, longitudinally extending blades.

Alternatively, the grinder includes four longitudinally extending blades in respective diametrically opposed pairs.

As a further alternative, the grinder can include a peripheral helical blade.

AS yet a further alternative the grinder can comprise an abrasive grinding surface.

Preferably, the grinding cavity includes an exit port communicating with the particle bin.

Preferably, the particle bin comprises a sliding drawer.

Preferably, the device further comprises a door covering the tablet chute.

Preferably, the device further comprises a gearbox for transmitting torque of the motor to the grinder.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
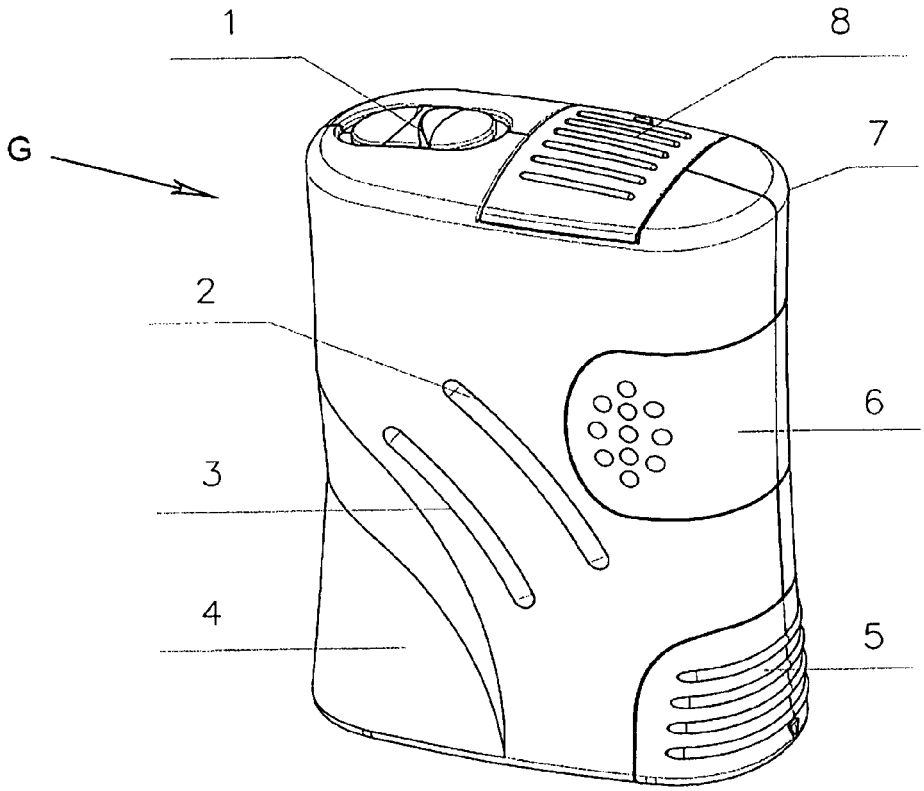
FIG. 1 is a schematic perspective illustration of a tablet grinding device.
Figure 2:
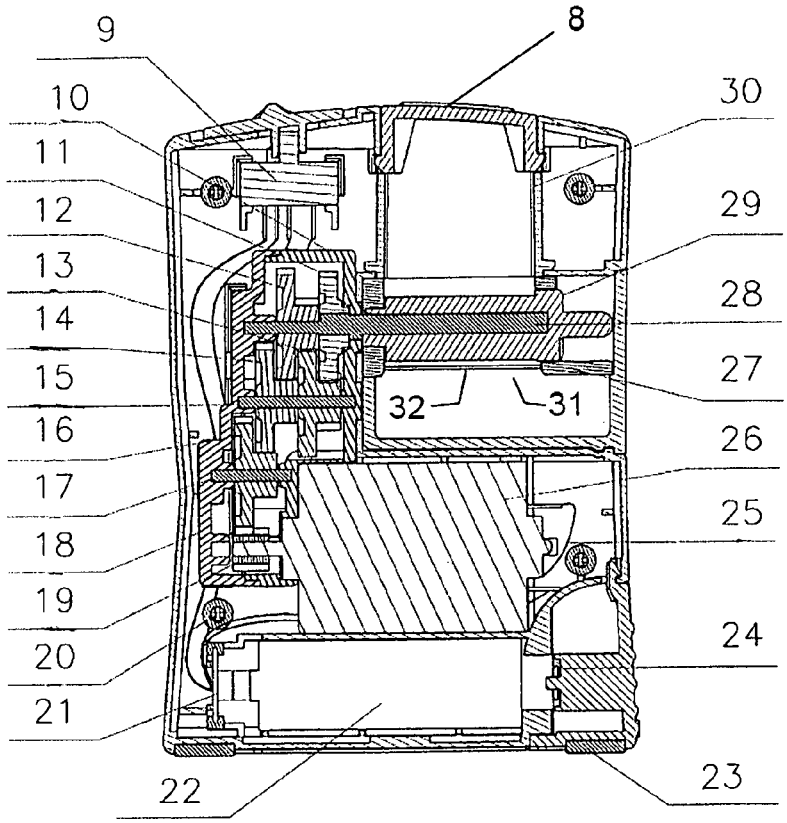
FIG. 2 is a schematic cross-sectional side elevation of the device of FIG. 1.

In the accompanying drawings there is depicted schematically a tablet grinding device G. The grinding device comprises a pair of body halves 4 and 7 typically of molded ABS plastics material and connected together to form a casing to which a footplate 23 is affixed. A number of rubber finger grips 2 and 3 are provided at the casing exterior.

Internally of the casing above the footplate 23, there is a battery compartment which houses a pair of batteries 22. An access door 5 encloses the battery compartment.

The batteries bear against a set of contact plates 21 and 24 from which wires extend to a switch 9 at the top of the casing. The switch 9 is in contact with a switch knob 1 that is exposed at the top of the casing.

Electrical wire 25 extends from the switch 9 to a DC electric motor 26 situated within the casing above the battery compartment.

A gearbox including casing parts 10 and 18 houses a number of reduction gears 11, 12, 13, 14, 16, 17 and 19 and shafts 15 and 17. The output shaft of motor 26 is input to the gearbox and the final gear 12 of the gearbox is mounted upon a grinder shaft 28 upon which a cylindrical grinder 29 is fixed so as to rotate therewith.

Figure 5:
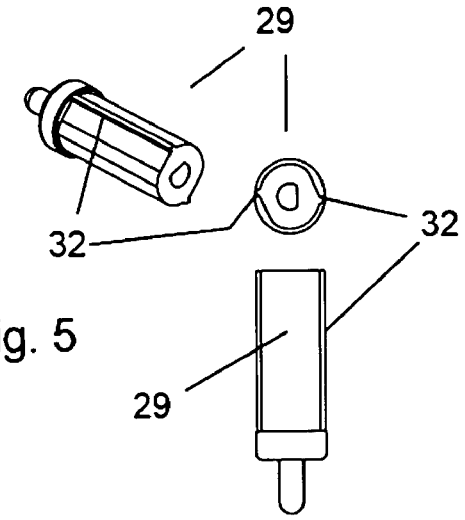
FIG. 5 is a schematic depiction of a twin blade cylindrical grinder.
Figure 6:
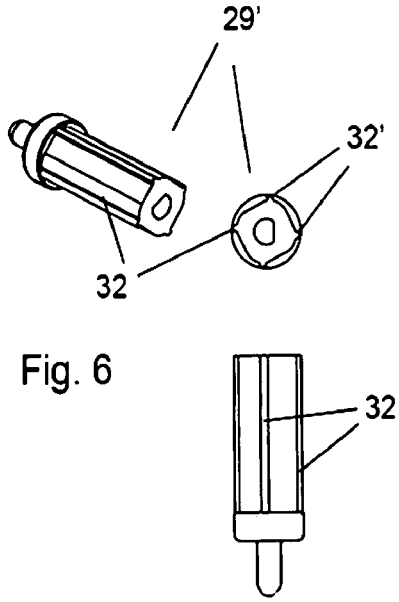
FIG. 6 is a schematic depiction of a four blade cylindrical grinder.
Figure 7:
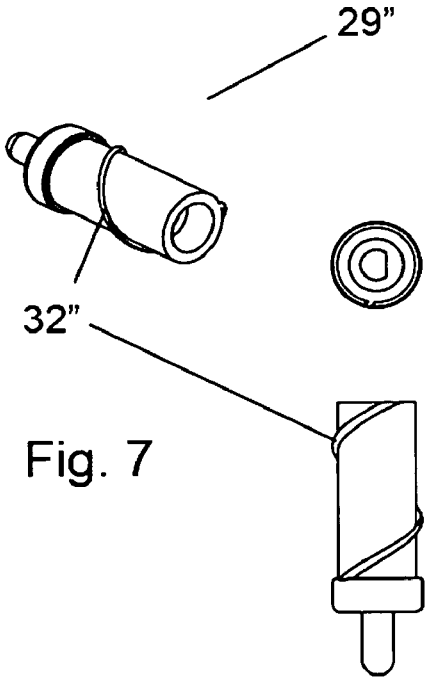
FIG. 7 is a schematic depiction of a helical blade cylindrical grinder.
Figure 8:
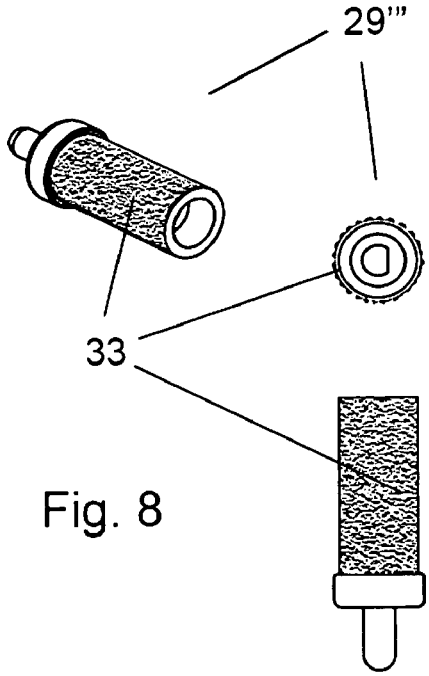
FIG. 8 is a schematic depiction of a cylindrical grinder having an abrasive grinding surface.

The grinder 29 is located within a cylindrical grinding cavity 27. The grinder 29 is typically made of steel and in one embodiment (FIG. 5) includes a pair of diametrically opposed, longitudinally extending straight blades 32. In another embodiment (FIG. 6), the cylindrical grinder 29' comprises four longitudinally extending straight blades 32' in respective diametrically opposed pairs separated by 90°. In a third embodiment (FIG. 7) the cylindrical grinder 29" includes a single helical blade 32", extending from one end of the grinder's cylindrical surface to the other. In another embodiment (not shown) two or more helical blades might be provided either extending in the same direction or crossing one another in opposite directions. In a fourth embodiment (FIG. 8), the outer surface of the cylindrical grinder 29''' has an abrasive surface 33 somewhat like the surface of sandpaper against which the tablets wear.

Figure 3:
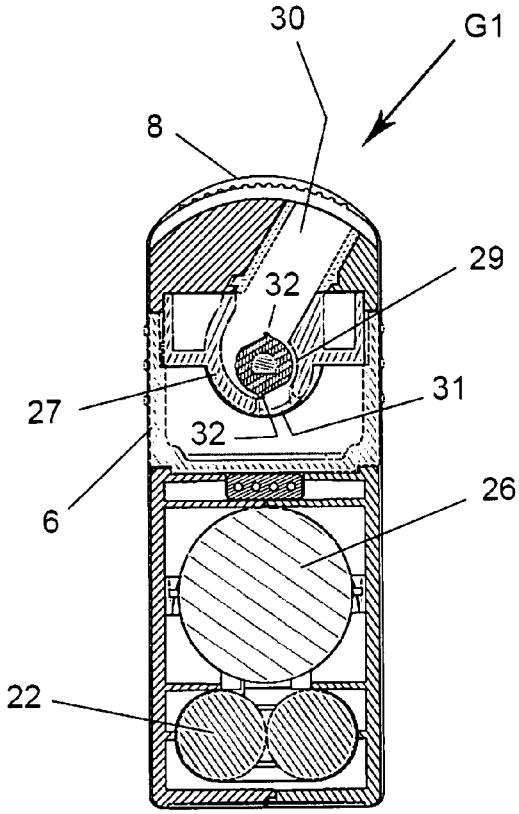
FIG. 3 is a schematic cross-sectional end elevation of the device of FIGS. 1 and 2 having a first tablet chute configuration.
Figure 4:
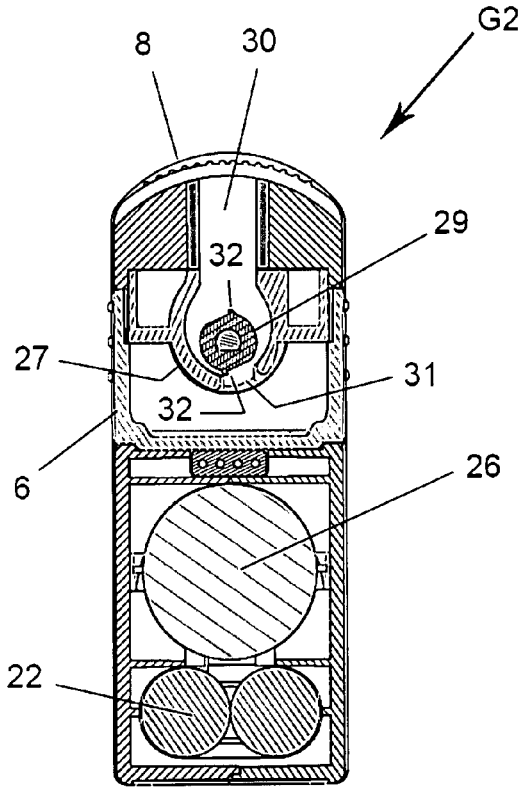
FIG. 4 is a schematic cross-sectional end elevation of a tablet grinding device having an alternative tablet chute configuration.

A tablet entry chute 30 extends from the top of the casing beneath a tablet chute door 8 to the cylindrical grinding cavity 27. In the embodiment depicted in FIG. 3, the entry chute 30 of tablet grinder G1 extends substantially tangentially from the grinding cavity 27, whereas in the embodiment G2 of FIG. 4, the grinding chute 30 extends radially of the grinder shaft 28.

The cylindrical grinding cavity 27 has an exit passage 31 communicating with a particle bin 6. The particle bin 6 attaches to the casing like a drawer which can be opened by sliding to reveal ground tablet particles, or removed completely for inversion to dispense ground particles therefrom.

In use, whole tablets are inserted into the tablet chute 30 after having opened the tablet chute cover 8. Either before inserting the tablets into the chute or thereafter, the user slides the switch knob 1 to activate the motor, which in turn drives the gearbox to rotate the cylindrical grinder 29. The blades 32, 32', or 32", disintegrate the tablet to form particulate material which falls downwardly via exit passage 31 to the particle bin 6. Once no further grinding sound is heard by the user, the switch knob 1 can be returned to its OFF position.

The switch knob 1 might have three positions. For example, it could have a central OFF position and FORWARD and REVERSE positions at either side of the OFF position enabling the user to reverse rotate the grinder 29 if necessary. To this end, the switch 9 can be connected electrically to motor 26 to energise it in either polarity.

It should be appreciated that modifications and alterations obvious to those skilled in the art are not to be considered as beyond the scope of the present invention. For example, the device might be provided with a tablet magazine for containing a plurality of tablets for individual delivery to the grinding cavity.

The invention claimed is:

1. A device for grinding tablets, comprising::

a body, an electric motor housed within the body, a power source connected to the electric motor via a switch, a substantially cylindrical grinder driven to rotate about a longitudinal axis thereof by the electric motor, the grinder having an outer surface configured to create friction with an object that comes into contact with the grinder, a gearbox for transmitting torque of the motor to the grinder, a housing defining a substantially cylindrical grinding cavity within which the grinder rotates, the housing having an effectively flat base, a tablet chute to the grinder that extends obliquely from the grinding cavity and with respect to the base, and a particle bin attached to or formed integrally with the body for receiving particles from the grinder.

2. The device of claim 1, wherein the grinder includes a pair of diametrically opposed, longitudinally extending blades.

3. The device of claim 1, wherein the grinder includes four longitudinally extending blades in respective diametrically opposed pairs.

4. The device of claim 1, wherein the grinder includes a peripheral helical blade.

5. The device of claim 1, wherein the grinder comprises an abrasive grinding surface.

6. The device of claim 1, wherein the grinding cavity includes an exit port communicating with the particle bin.

7. The device of claim 1, wherein the particle bin comprises a sliding drawer.

8. The device of claim 1, further comprising a door covering the tablet chute.

* * * * *